US012429043B2

(12) United States Patent
Souza

(10) Patent No.: US 12,429,043 B2
(45) Date of Patent: Sep. 30, 2025

(54) METHOD AND SYSTEM FOR REDUCING NOISE AND FOR POSITIONING OF PISTON IN A COMPRESSOR DURING MOTOR STARTUP

(71) Applicant: NIDEC GLOBAL APPLIANCE BRASIL LTDA., Joinville (BR)

(72) Inventor: Marcos Roberto De Souza, Joinville (BR)

(73) Assignee: NIDEC GLOBAL APPLIANCE BRASIL LTDA., Joinville (BR)

( * ) Notice: Subject to any disclaimer, the term of this patent is extended or adjusted under 35 U.S.C. 154(b) by 665 days.

(21) Appl. No.: 17/787,011

(22) PCT Filed: Dec. 17, 2020

(86) PCT No.: PCT/BR2020/050558
§ 371 (c)(1),
(2) Date: Jun. 17, 2022

(87) PCT Pub. No.: WO2021/119789
PCT Pub. Date: Jun. 24, 2021

(65) Prior Publication Data

US 2023/0020185 A1 Jan. 19, 2023

(30) Foreign Application Priority Data

Dec. 19, 2019 (BR) ..... 10 2019 027356 9

(51) Int. Cl.
*F04B 49/06* (2006.01)
*F04B 35/04* (2006.01)

(52) U.S. Cl.
CPC ..... *F04B 49/06* (2013.01); *F04B 35/04* (2013.01); *F04B 2201/0201* (2013.01)

(58) Field of Classification Search
CPC .. F04B 49/06; F04B 35/04; F04B 2201/0201; F04B 49/10; F04B 53/001; F04B 2201/0206; F04B 2201/0209
See application file for complete search history.

(56) References Cited

U.S. PATENT DOCUMENTS

2007/0098566 A1* 5/2007 Heo ..... F04B 49/065 417/44.1
2014/0212266 A1* 7/2014 Lee ..... F04D 27/004 415/119
2018/0195509 A1* 7/2018 Lim ..... F04B 49/065

FOREIGN PATENT DOCUMENTS

EP 1 775 473 A1 4/2007
EP 2 669 519 A1 12/2013
WO WO-2005/029692 A1 3/2005

OTHER PUBLICATIONS

International Search Report & Written Opinion of the International Searching Authority issued in PCT Application No. PCT/BR2020/050558, mailed Mar. 17, 2021.

* cited by examiner

*Primary Examiner* — Bryan M Lettman
(74) *Attorney, Agent, or Firm* — FOLEY & LARDNER LLP

(57) ABSTRACT

A method and system for reducing the noise generated during a starting failure of a compressor motor and for allowing the piston (15) to be positioned in a position more favorable for a new start, the method being executed by a failure detection logic (100), a de-energization logic (200) and a positioning logic (300) of piston (15). The failure detection logic (100) comprises the steps of: obtaining at least one current position (S0), one more favorable position (S1) and one next position (S2) of the piston (15); and comparing the next position (S2) with the most favorable position (S1). The de-energizing logic (200) comprises the (Continued)

step of keeping the magnetic field active. The positioning logic (300) of piston (15) comprises the step of positioning the piston (15) in a new current position (50).

20 Claims, 5 Drawing Sheets

METHOD AND SYSTEM FOR REDUCING NOISE AND FOR POSITIONING OF PISTON IN A COMPRESSOR DURING MOTOR STARTUP

CROSS REFERENCE TO RELATED APPLICATIONS

This application is a national stage entry of PCT Application No. PCT/BR2020/050558, filed on Dec. 17, 2020, which claims priority to Brazilian Application No. 10 2019 027356 9, filed on Dec. 19, 2019, the contents of all of which are incorporated herein by reference in their entireties.

The present invention refers to a method and system for reducing noise and positioning of piston in starting failure of engine configured to significantly reduce the noise generated during a starting failure of the engine, in addition to allow the piston to be positioned in a position more favorable to a new start.

DESCRIPTION OF THE STATE OF THE ART

It is known that engines widely used in several areas, mainly industrial, sometimes suffer from starting failures, caused by several factors. In addition, such failure generates undesirable noises through impacts of the compressor kit on the housing thereof. This problem is referred to as knocking noise (KN).

More specifically, when the piston comes out of inertia and begins to compress the gas, depending on the conditions of the cooling system, the engine does not have enough force to overcome the gas pressure, failing to complete the cycle (suction/compression).

The rotor starts to rotate leaving an initial position and advances towards the next positions. During the compression cycle, the gas contained in a chamber is compressed. The engine fails when it does not have enough force to compress the gas and move the shaft to the next position.

Currently, when it is detected that the rotor has not reached the next expected position, the electronic switches that supply the engine are promptly turned off. This causes the piston to become loose and, therefore, the gas compressed in the chamber pushes the piston back, causing a jolt to occur in the compressor kit (which is supported by springs), and this kit collides with the engine housing, generating the noise mentioned above (knocking noise).

There are some technologies developed to try to solve this noise problem. Document US20140212266A1, for example, describes a technology based on the engine speed control and is configured only to perform a brief maintenance of the current position of the engine by maintaining the same pair of switches previously activated.

Documents US20180195509 A1 and US 20070098566A1 do not disclose a gradual reduction in voltage applied to the compressor engine, knowing and optimizing the piston position to facilitate a starting after a possible failure.

Therefore, in the state of the art, there is no solution configured to gradually reduce the voltage applied to the compressor engine in the event of a possible failure in said compressor and further obtain piston position data to optimize the positioning thereof for a later start.

OBJECTIVES OF THE INVENTION

An objective of the present invention is to provide a method and system configured to reduce noise in engine starting failure.

An objective of the present invention is to provide a method and system configured to allow a new piston positioning in engine starting failure.

An objective of the present invention is to provide a method and system configured to progressively reduce the voltage in engine control switches.

An objective of the present invention is to provide an engine with noise reduction and piston positioning in starting failure.

BRIEF DESCRIPTION OF THE INVENTION

The objectives of the present invention are achieved by means of a method of noise reduction and piston positioning in engine starting failure configured through a failure detection logic, a de-energizing logic and a piston positioning logic, in that the engine is driven by means of a set of keys. The objectives of the present invention are achieved by means of a noise reduction system and piston positioning in engine starting failure and by means of an engine itself, compatible with said method.

BRIEF DESCRIPTION OF DRAWINGS

The present invention will be described in more details below based on an example of execution shown in the drawings. The figures show.

DETAILED DESCRIPTION OF THE DRAWINGS

In principle, the present invention relates to a method of noise reduction and positioning of piston 15 in a cylinder 25 in starting failure of engine 20. For this purpose, said engine 20 is, for example, equipped with a rotor with 12 alignment positions, but it should be understood that this feature is not a limitation of the present invention, so that it can be implemented using other engines.

In any case, it is observed that the engine 20 used is at least connected to piston 15 electrically or mechanically, so that said piston 15 acts according to the operation of engine 20, which, in turn, must be understood as being able to be driven by a set of keys. It is observed especially in FIGS. 3 to 5 that these keys are identified by the numerical sequence 1-12. In a preferred configuration, the keys can be IGBTs or MOSFETs and alternatively they can be any other key that fits the present invention and the objectives thereof.

Figure 3A:
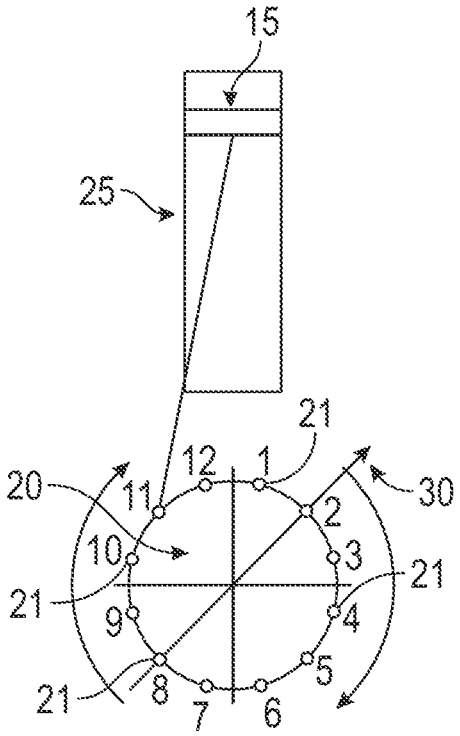
FIG. 3*a*—is an example of positioning a piston in the compression phase.
Figure 3B:
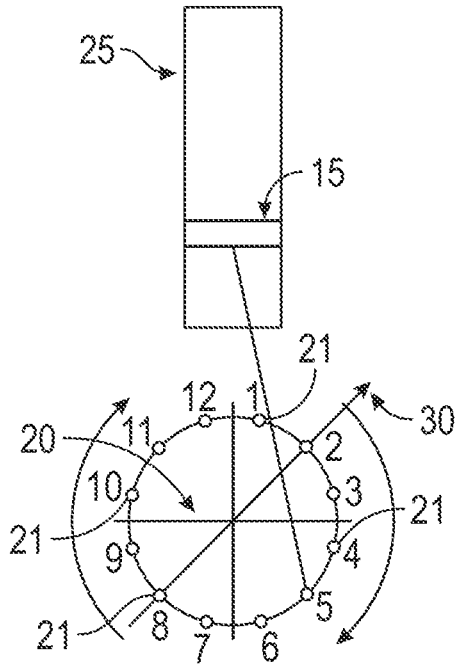
FIG. 3*b*—is an example of positioning a piston in the suction phase.

In addition, FIGS. 3*a* and 3*b* disclose examples of positioning a piston in the compression and suction phase, respectively, also exemplifying a magnetic field 30.

Figure 4C:
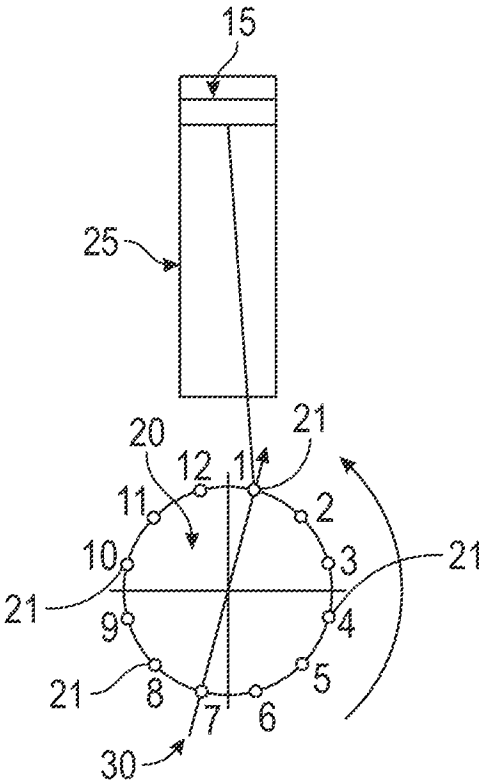
FIGS. 4*a*, 4*b* and 4*c*—are examples of magnetic field alignments according to the piston positioning.
Figure 4B:
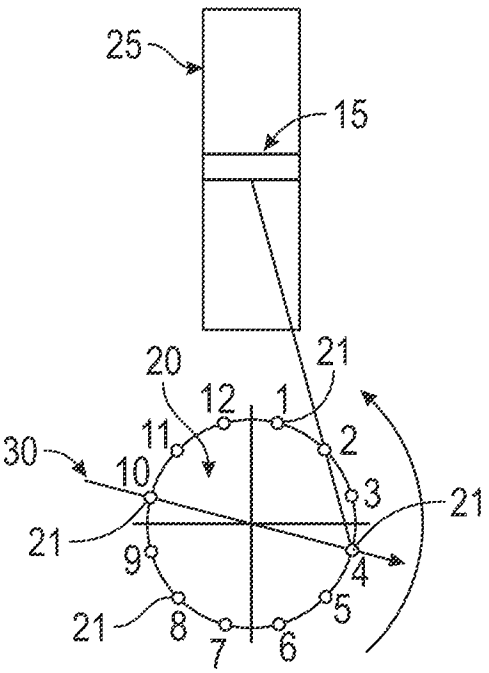
Figure 4A:
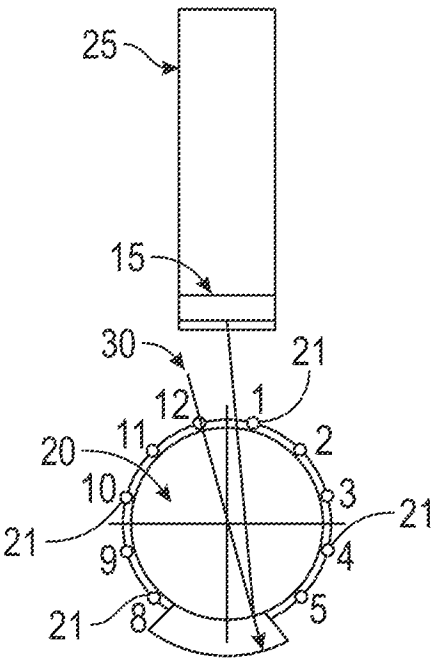

FIGS. 4*a*, 4*b* and 4*c* show a possible operation of piston 15, showing possible alignments of the magnetic field 30 of the engine according to the positioning of piston 15 in different phases.

Figure 6:
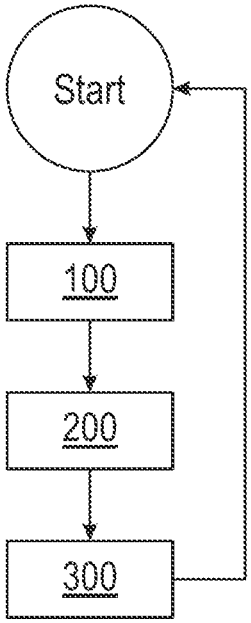
FIG. 6—is a flowchart exemplifying a configuration of the present invention.

In general, the present invention is configured by means of a failure detection logic 100, a de-energizing logic 200 and a positioning logic 300 of piston 15, as can be seen especially in FIG. 6.

In one configuration, failure detection logic 100 comprises a step of obtaining at least one current position S0, one more favorable position S1 and one next position S2 of piston 15. Briefly, the current position S0 is determined by a combination of the set of keys. The combination of these switches positions piston 15 at a given current position S0. Knowing the position S0, it is possible to determine the most favorable position S1 and the next position S2 of piston 15.

In relation to these positions, it is observed:

Current position S0: it is configured as an initial position, that is, the position in which piston 15 is in an initial instant ("now").

Most favorable position S1: it is configured as the most favorable position that must be reached by the piston immediately after the current position S0, that is, it is a more favorable position which piston 15 must go to when traveling from the current position S0, that is, it is the position that the piston is supposed (estimated) to reach after the current position S0. It may or may not be the same as the next position S2.

Next position S2: it is configured as the position actually reached by the piston immediately after the current position S0, that is, it is the position to which piston 15 actually left the current position S0. It may or may not be equal to the most favorable position S1.

Once these positions are obtained, the failure detection logic 100 comprises a step of comparing the next position S2 with the most favorable position S1, in which they may or may not be the same (coincide).

If the next position S2 is equal to the most favorable position S1, it is understood that there was no failure in the starting of engine 20, in which it starts to operate normally.

If the next position S2 is not equal to the most favorable position S1, it is understood that there was a failure to start the engine 20.

A failure of the type described above is exemplified mainly in FIG. 5. It can be seen in this figure, starting from left to right, that engine 20 starts its drive by leaving position 8 and starts to rotate going to position 9 and so on, that is, in a clockwise direction (obviously, the direction of rotation should not be understood as a limitation for the present invention). It is to be noted that at each change of position (between positions 7 to 12) the gas contained in the chamber is compressed.

At this point in the example, when the shaft reaches position 12, it is observed that the engine did not have enough force to compress the gas and move the piston shaft 15 to position 1, that is, it is noted in this example that the current position S0 is position 12, the most favorable position S1 is position 1 and the next position S2 is position 11. Alternatively, using time logic, the invention is configured to wait for position S1 until time expires, and at this point the position failure would be identified.

Figure 5:
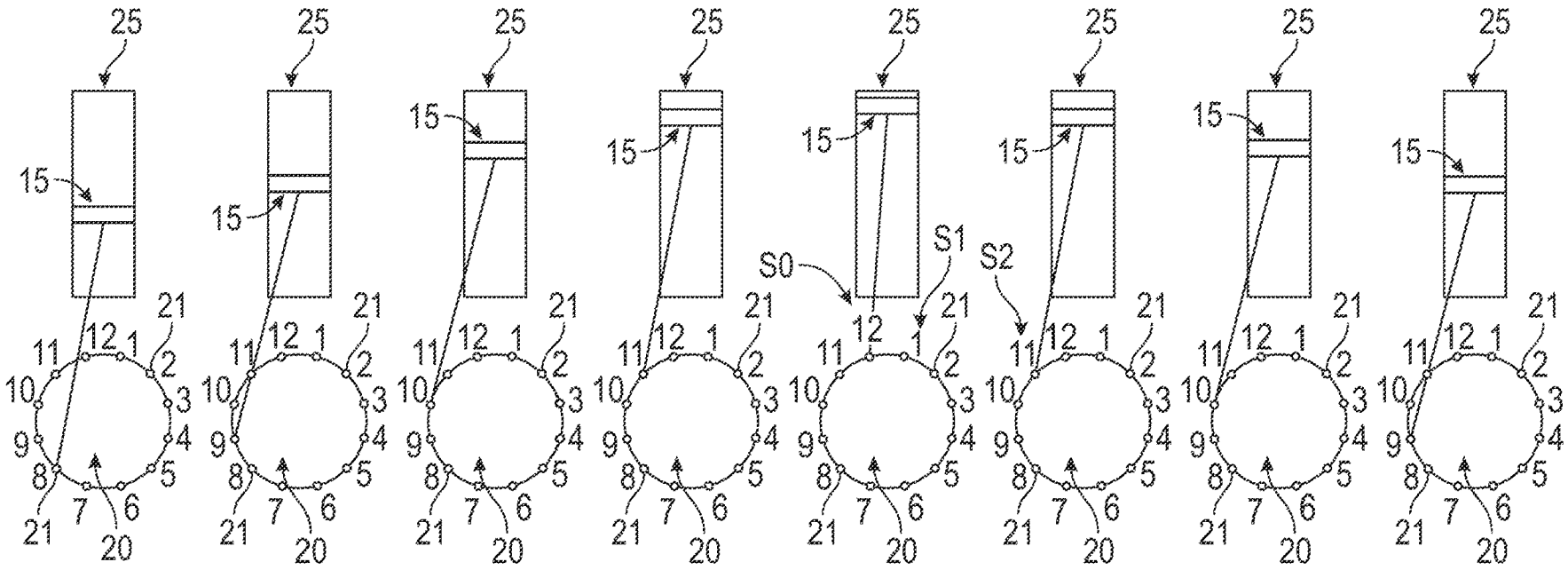
FIG. 5—is a demonstration of failure in the engine activation, exemplifying the piston's behavior in this scenario and highlighting its positions.

In other words, FIG. 5 shows that piston 15 was in position 12 (current position S0=12), it was expected to go to position 1 (most favorable position S1=1), but the piston 15 did not reach such position 1. In this case, the example in FIG. 5 shows that piston 15 reached position 11, that is, in fact, it did not reach position 1. However, it should be noted that it is only necessary to know whether piston 15 has reached whether or not the most favorable position S1. If it has not reached it, piston 15 may have stayed in position 12, for example.

When this condition is detected, that is, that the next expected position has not been reached (position S2 different from position S1), a failure is detected.

Thus, the failure detection logic 100 is configured to detect the failure at least when the next position S2 is different from the most favorable position S1.

Figure 1:
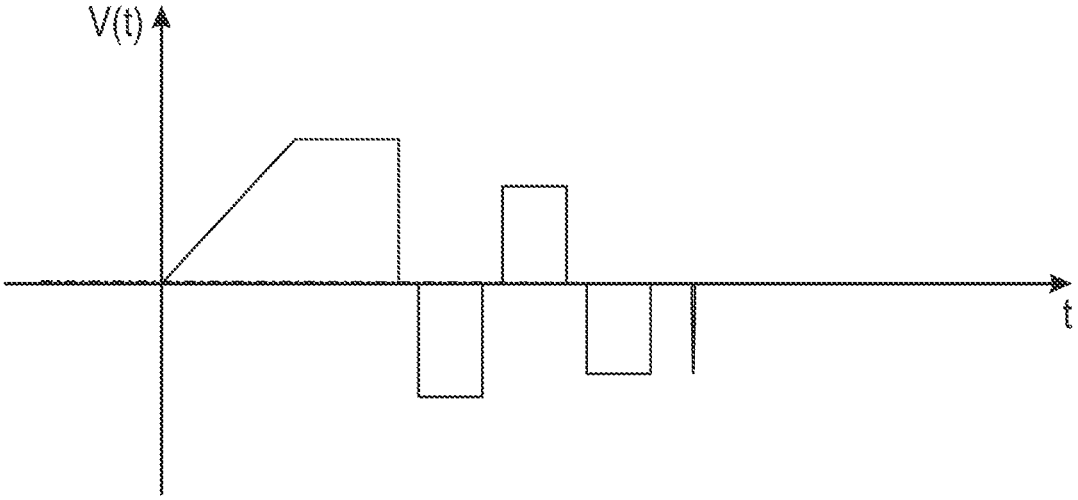
FIG. 1—is a graph showing a failure in the engine activation and its immediate de-energization, according to the state of the art.

In this case, when there is a failure detection, the technologies of the state of the art are configured to quickly turn off all the switches and de-energize the engine 20, as shown in the graph in FIG. 1. In addition, this configuration causes the gas compressed inside the cylinder to push piston 15 in the opposite direction, causing unwanted noise, causing an engine kit 20 to move, increasing the chance of it colliding with the compressor wall, in addition to completely losing the piston positioning reference.

Figure 2:
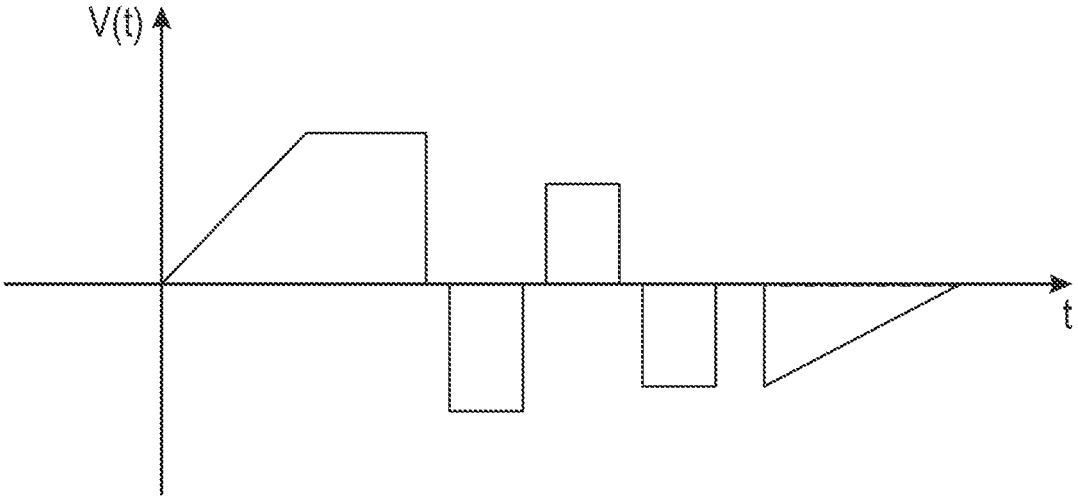
FIG. 2—is a graph showing a failure in the engine activation and its progressive de-energization, according to the present invention.

On the other hand, as shown in FIG. 2, the present invention is configured to perform a gradual reduction in the magnetic field of the engine 20 when a failure is detected at the start, avoiding the generation of noise. In this case, the compressed gas inside the cylinder gradually pushes the piston 15 to a rest position (such as a lower dead center), so that this position is known. In this way, when the magnetic field is kept active, the piston 15 is stuck to a certain position, the gas begins to escape through the walls of the cylinder, while the magnetic field of the engine 20 is gradually reduced. As the magnetic field decreases, the gas still contained within the cylinder pushes piston 15 back to other positions, which is done more slowly. That is, all the energy contained by the compression of the gas is gradually dissipated and, thus, there is a reduction in the displacement of the kit in the opposite direction to the displacement and thus reducing the possibility of collision of the kit with the compressor wall.

According to the teachings of the present invention, when failure is detected, the de-energizing logic 200 of the present invention starts to act, as shown especially in FIG. 2. This logic comprises at least one step of keeping the magnetic field active.

In relation to said FIG. 2, when the control detects that a failure in the starting has occurred, instead of switching off extinguishing the magnetic field, the present invention is configured to keep the magnetic field active for a certain period of time.

In other words, the step of the de-energizing logic 200 of keeping at least two keys 21 of the set of energized keys is performed at least temporarily, thus keeping at least temporarily the piston 15 in the respective next position S2 so that the gas that is still contained inside the cylinder can push the piston 15 back to other positions slowly, thereby dissipating the energy that would move the kit with force and allowing to prevent the piston from colliding with the compressor. It is noted, therefore, that according to the teachings of the present invention, this movement advantageously does not occur abruptly as when the magnetic field is extinguished immediately, but more slowly.

Alternatively, the failure detection logic 100 can be configured, for example, to operate based on a time measurement, that is, starting from a starting position (for example, the current position S0), delimiting a maximum time for piston 15 of engine 20 to reach a next position (for example, the most favorable position S1).

If an elapsed time is longer than the defined time, it is understood that a failure has occurred and the engine 20 has not reached the expected position. In this case, to detect that a positioning failure of the engine 20 has occurred, it is not necessary to know a next position (for example, the next position S2), it is enough to know that the piston 15 of the engine 20 has not reached the next position (for example, the most favorable position S1) within a limited time.

Otherwise, in which the next position (for example, the most favorable position S1) is reached within a limited time, it is noted that engine 20 is operating normally.

In general, it should be noted that the positions are observed by means of a sensor, configured to identify the position of the piston 15.

In its turn and in line with what has been described above, the piston positioning logic 300 comprises a step of progressively reducing the magnetic field applied to the engine.

Advantageously, this prevents the compressed gas in the chamber from being able to push the piston 15 back. Thus, as the magnetic field in the engine 20 decreases, the gas pushes the piston 15, but this occurs in a smoother way, thus avoiding excessive vibration of the kit, fatigue of some components such as the spring in addition to avoid hitting the kit on the engine frame 20.

Moreover, this same logic comprises a step of positioning the piston in a new current position S0. That is, from the moment the piston 15 stops (for example, between position 6 or 7), and as it is known where the failure occurred (for example, in position 12), it is possible from this information to position the shaft of engine 20 in the position most favorable to a new start (for example, in position 1).

With the shaft positioned in position 1, the engine 20 has an entire suction cycle to gain speed and to be able to store power to overcome the gas pressure, advantageously increasing the chances of a successful start.

In this scenario, it is noted that the present method can also comprise a step of starting the engine from the new current position S0.

This means that, after the progressive reduction of the magnetic field applied to the engine after the failure detection, the engine assumes a new initial position S0, in which the logic of failure detection, de-energization and piston positioning are carried out until the next position S2 and the most favorable position S1 are the same, that is, until the engine is able to operate normally.

The present invention also comprises a noise reduction and piston positioning system in engine starting failure, in which said system is compatible with the method described above and composed at least of a power unit, a failure detection module and an actuation module.

Regarding the components of this system, it is noted that the power module comprises at least one set of keys 21. These keys 21 can be understood as being of the type configured to act on the selective drive of the engine 20.

In a configuration of the present invention, the power module is configured to selectively energize the set of keys 21 and allow the engine 20 to start.

The failure detection module in turn comprises at least one data processing element, such as a sensor or set of sensors, configured to measure and process data, sending information to the actuation module.

In a configuration of the present invention, the failure detection module is configured to obtain at least one current position S0, one more favorable position S1 and one position next S2 of the piston, such positions having already been previously described in detail. This module is further configured to compare the next position S2 with the most favorable position S1, thus detecting a failure at least when the next position S2 is different from the most favorable position S1, as previously explained.

The actuation module, on the other hand, comprises at least one configured control element such as a microcontroller type control device, PC, among others. This actuation module is configured to receive data from the failure detection module and is, therefore, in electrical communication with the failure detection module.

Thus, the actuation module is configured to gradually reduce the voltage on the switches 21 of the energized set of keys 21, in which the power module is responsible for selectively energizing the set of keys 21 and allows the engine 20 to start.

Thus, if a failure is detected and the actuation module allows (enable) the progressive reduction of the voltage in the keys of the energized set of keys 21, the power module progressively reduces the voltage in the keys of the energized set of keys 21 and position piston 15 in a new current position S0.

Further in relation to the power module, as already described, it is configured to keep at least two keys of the set of keys 21 energized if the next position S2 and the most favorable position S1 detected by the failure detection module are different.

More specifically, the supply module is configured to keep at least two keys of the set of keys 21 energized at least temporarily, keeping at least temporarily piston 15 in the next position S2 and allowing to prevent piston 15 from colliding with the compressor.

In a configuration, the actuation module is also configured to start the engine from the new current position S0, as previously described.

It should be noted that the configuration of the modules that make up the system of the present invention is compatible with the method previously described. Therefore, it must be understood that, when the necessary adaptations are made, the characteristics of the method and the system are common.

Additionally, the present invention further comprises an engine 20 with noise reduction and piston positioning in configured starting failure such as the method and system which are also objects of the present invention.

Finally, the present invention also comprises a compressor equipped with an engine 20 with noise reduction and piston positioning 15 in starting failure and a cooling system provided with at least one said compressor.

Having described an example of preferred embodiment, it should be understood that the scope of the present invention covers other possible variations, it being limited only by the content of the attached claims, including the possible equivalents therein.

The invention claimed is:

1. A method for reducing noise and positioning of a piston (15) in a piston compressor during a starting failure of an electric motor (20) driving the piston compressor configured by means of a failure detection logic (100), a de-energization logic (200) and a positioning logic (300) of the piston (15), the electric motor (20) being driven by means of a set of keys (21), the method for reducing noise and positioning of the piston (15) in the starting failure of the electric motor (20) being characterized in that:

the failure detection logic (100) comprises at least the steps of:

obtaining at least one current position (S0), one more favorable position (S1) and one next position (S2) of the piston (15);

comparing the next position (S2) with the most favorable position (S1);

the de-energizing logic (200) comprises at least the step of:

keeping a magnetic field active;

the positioning logic (300) of piston (15) comprises the step of:

positioning the piston (15) in a new current position (S0).

2. The method for reducing noise and positioning of the piston (15) in the piston compressor during the starting failure of the electric motor (20), according to claim 1, characterized in that the failure detection logic (100) is configured to detect the failure at least when the next position (S2) is different from the most favorable position (S1), and the positioning logic (300) of piston (15) also comprises a step of:

progressively reducing a voltage on the keys of the energized set of keys (21).

3. The method for reducing noise and positioning of the piston (15) in the piston compressor during the starting failure of the electric motor (20), according to claim 2, characterized in that the current position (S0) is configured as an initial position, the most favorable position (S1) is configured such as the most favorable position that must be reached by the piston (15) immediately after the current position (S0) and the next position (S2) is configured such as the position actually reached by the piston (15) immediately after the current position (S0).

4. The method for reducing noise and positioning of the piston (15) in the piston compressor during the starting failure of the electric motor (20), according to claim 3, characterized in that the step of maintaining the active magnetic field of the de-energizing logic (200) is performed if the next position (S2) is different from the most favorable position (S1).

5. The method for reducing noise and positioning of the piston (15) in the piston compressor during the starting failure of the electric motor (20), according to claim 4, characterized in that the step of maintaining the magnetic field of the de-energizing logic (200) is performed at least temporarily, avoiding large movements of the kit with the housing and fatigue problems.

6. The method for reducing noise and positioning of the piston (15) in the piston compressor during the starting failure of the electric motor (20), according to claim 5, characterized in that it can also comprise a step of starting the electric motor (20) from the new current position (S0), wherein the logics of failure detection (100), de-energizing (200) and positioning (300) of piston (15) are carried out until the next position (S2) and the most favorable (S1) are equal.

7. The method for reducing noise and positioning of the piston (15) in the piston compressor during the starting failure of the electric motor (20), according to claim 6, characterized in that the method further comprises an additional step of determining the current position (S0) of the piston (15) through a combination of the set of keys.

8. The method for reducing noise and positioning of the piston (15) in the piston compressor during the starting failure of the electric motor (20), according to claim 7, characterized in that the method is configured to operate based on a time measurement, in which said method comprises the steps of delimiting a maximum time for the piston (15) of the electric motor (20) to reach a more favorable position (S1) from a current position (S0), checking if the piston (15) of the electric motor (20) reached the most favorable position (S1) within the time limit and selectively detect a failure if the piston (15) of the electric motor (20) does not reach the most favorable position (S1) within the time limit.

9. The method for reducing noise and positioning of the piston (15) in the piston compressor during the starting failure of the electric motor (20), according to claim 3, characterized in that the keys of the set of keys are at least one among IGBT's and MOSFETs.

10. An electric motor (20) with the noise reduction and piston positioning (15) during the piston compressor starting failure characterized in that the method is configured as the method and system defined in claim 1.

11. A compressor equipped with the electric motor (20) with the noise reduction and piston positioning (15) during the piston compressor starting failure characterized in that it is configured as the method and system defined in claim 1.

12. A refrigeration system characterized in that the system is equipped with at least one compressor configured as defined in claim 11.

13. A system for reducing noise and positioning of a piston (15) in a piston compressor during a starting failure of an electric motor (20) attached to the piston compressor consisting of at least one supply unit, one failure detection module and one actuation module, wherein the supply unit comprises at least one set of keys, the failure detection module comprises at least one data processor element and the actuation module comprises at least one control element, the system for reducing noise and positioning of piston (15) in starting failure of electric motor (20) being characterized in that:

the supply unit is configured to selectively energize the at least one set of keys and allow the electric motor (20) to start;

the failure detection module is configured to obtain at least one current position (S0), one most favorable position (S1) and one next position (S2) of the piston and compare the next position (S2) with the most favorable position (S1);

the actuation module is configured to gradually reduce a voltage on the selectively energized keys of the at least one set of keys and to position the piston (15) in a new current position (S0).

14. The system for reducing noise and positioning of the piston in the compressor during the starting failure of the electric motor (20), according to claim 13, characterized in that the failure detection module is configured to detect the failure at least when the next position (S2) is different from the most favorable position (S1).

15. The system for reducing noise and positioning of the piston in the compressor during the starting failure of the electric motor (20), according to claim 14, characterized in that the power module is configured to keep a magnetic field active at least temporarily, maintaining at least temporarily the piston (15) in the next position (S2) and avoiding large movements of the kit with the housing and fatigue problems.

16. The system for reducing noise and positioning of the piston in the compressor during the starting failure of the electric motor (20), according to claim 14, characterized in that the actuation module is further configured to start the electric motor (20) from the new current position (S0).

17. The system for reducing noise and positioning of the piston in the compressor during the starting failure of the electric motor (20), according to claim 14, characterized in that the current position (S0) of the piston (15) is determined through a combination of the at least one set of keys.

18. The system for reducing noise and positioning of the piston in the compressor during the starting failure of the electric motor (20), according to claim 17, characterized in that the keys of the at least one set of keys are at least one among IGBT's and MOSFETs.

19. The system for reducing noise and positioning of the piston in the compressor during the starting failure of the electric motor (20), according to claim 13, characterized in that the current position (S0) is configured as an initial position, the most favorable position (S1) is configured as the most favorable position (S1) that must be reached by the piston immediately after the current position (S0) and the next position (S2) is configured such as the position actually reached by the piston immediately after the current position (S0).

20. The system for reducing noise and positioning of the piston in the compressor during the starting failure of the electric motor (20), according to claim 13, characterized in that the power module is configured to keep a magnetic field active if the next position (S2) and the most favorable position (S1) detected by the failure detection module are different.

* * * * *